US009085967B2

(12) United States Patent
Bennett

(10) Patent No.: US 9,085,967 B2
(45) Date of Patent: Jul. 21, 2015

(54) ADJUSTABLE CONE EXPANSION SYSTEMS AND METHODS

(75) Inventor: Frederick Cornell Bennett, Houston, TX (US)

(73) Assignee: ENVENTURE GLOBAL TECHNOLOGY, INC., Houston, TX (US)

( * ) Notice: Subject to any disclaimer, the term of this patent is extended or adjusted under 35 U.S.C. 154(b) by 550 days.

(21) Appl. No.: 13/467,612

(22) Filed: May 9, 2012

(65) Prior Publication Data

US 2013/0299197 A1 Nov. 14, 2013

(51) Int. Cl.
*E21B 43/10* (2006.01)

(52) U.S. Cl.
CPC ..... *E21B 43/105* (2013.01)

(58) Field of Classification Search
CPC ..... E21B 43/105
USPC ..... 166/208, 207, 380, 384, 217
See application file for complete search history.

(56) References Cited

U.S. PATENT DOCUMENTS

| | | | | |
|---|---|---|---|---|
| 4,440,223 | A * | 4/1984 | Akkerman | 166/217 |
| 6,012,523 | A | 1/2000 | Campbell et al. | |
| 6,460,615 | B1 | 10/2002 | Heijnen | |
| 7,114,559 | B2 | 10/2006 | Sonnier et al. | |
| 7,128,146 | B2 | 10/2006 | Baugh et al. | |
| 7,140,430 | B2 | 11/2006 | Wubben | |
| 7,222,669 | B2 * | 5/2007 | Sonnier et al. | 166/206 |
| 7,243,731 | B2 | 7/2007 | Watson et al. | |
| 7,383,889 | B2 | 6/2008 | Ring et al. | |
| 7,416,027 | B2 | 8/2008 | Ring et al. | |
| 7,506,687 | B2 | 3/2009 | Ring | |
| 7,559,365 | B2 * | 7/2009 | Watson et al. | 166/207 |
| 7,681,636 | B2 * | 3/2010 | Roggeband et al. | 166/207 |
| 7,779,910 | B2 | 8/2010 | Watson | |
| 7,980,302 | B2 | 7/2011 | Ring et al. | |
| 8,020,625 | B2 | 9/2011 | Ring et al. | |
| 2005/0045342 | A1 * | 3/2005 | Luke et al. | 166/384 |
| 2005/0103502 | A1 * | 5/2005 | Watson et al. | 166/380 |
| 2011/0000664 | A1 | 1/2011 | Adam et al. | |

OTHER PUBLICATIONS

International Report of Patentability and Written Opinion dated Aug. 20, 2013 for corresponding International Application No. PCT/US2013/040102 (12 pgs.).

* cited by examiner

*Primary Examiner* — Cathleen Hutchins
*Assistant Examiner* — Tara Schimpf
(74) *Attorney, Agent, or Firm* — Derek V. Forinash; Porter Hedges LLP

(57) ABSTRACT

An expansion system including a mandrel slidably coupled to plurality of primary cone segments that are interleaved with a plurality of secondary cone segments. The expansion system has a the first position wherein the primary cone segments and secondary cone segments are in a retracted position, a second position wherein the primary cone segments are in an expanded position and the secondary cone segments are in a retracted position, and a third position wherein the primary cone segments and the secondary cone segments are in an expanded position. When the expansion assembly is disposed within a tubular member and in the second position, the primary cone segments expand the tubular member into a tri-lobe cross-sectional shape.

17 Claims, 5 Drawing Sheets

ADJUSTABLE CONE EXPANSION SYSTEMS AND METHODS

CROSS-REFERENCE TO RELATED APPLICATIONS

None

BACKGROUND

This disclosure relates generally to methods and apparatus for expanding a tubular member in a wellbore. More specifically, this disclosure relates to expanding a tubular member using an adjustable expansion cone.

Wellbore tubular members, such as casings or liners, can be expanded in the wellbore using a variety of known processes. These processes often utilize expansion cones that are shaped to radially expand the tubular as the cone moved axially through the tubular. Many conventional expansion cones have a fixed outer diameter that is larger than the outer diameter of tubular member before expansion. The size of the fixed diameter expansion cone necessitates that, before expansion begins, the cone is contained within an enlarged section of the tubular, known as a launcher, or disposed outside of the tubular being expanded.

The launcher, or the expansion cone itself, is thus the component of the tool string having the largest outer diameter and is therefore a major factor in determining the operating envelope of the system. For example, if an expandable tubular is needed at a location in the wellbore below a restriction, the size of the launcher or cone will limit the systems that can be used. Fixed diameter cones are also susceptible to getting stuck in the unexpanded tubular should the expansion process fail or an unexpected restriction be encountered.

Adjustable expansion cones have been used to overcome some of the limitations of fixed diameter cones by providing a mechanism for varying the outer diameter of the cone. Adjustable expansion cones generally include a plurality of segments that are "assembled" downhole into a cone capable of expanding a tubular member. Adjustable cones are available in a variety of styles and configurations but, like conventional fixed diameter cones, suffer from certain performance limitations.

One issue that has limited the use of adjustable cones is the force needed to assemble the cone. If the cone is assembled in the tubular, the force needed to assemble the cone while simultaneously expanding the tubular can be significant. Previous systems have addressed this issue by including specialized force generators to provide the needed force and/or assembling the cone within a thin-walled section of the tubular in order to reduce the forces required. Certain systems include mechanisms to extend the adjustable cone out of the lower end of the tubular so as to assemble the cone in the open wellbore and avoid the problems caused by assembling the cone and expanding the tubular simultaneously. Each of these solutions adds complexity and costs to the expansion system.

Thus, there is a continuing need in the art for methods and apparatus for adjustable expansion cones that overcome these and other limitations of the prior art.

BRIEF SUMMARY OF THE DISCLOSURE

One embodiment of the disclosure provides an expansion system comprising a mandrel slidably coupled to plurality of primary cone segments that are interleaved with a plurality of secondary cone segments. The expansion system has a the first position wherein the primary cone segments and secondary cone segments are in a retracted position, a second position wherein the primary cone segments are in an expanded position and the secondary cone segments are in a retracted position, and a third position wherein the primary cone segments and the secondary cone segments are in an expanded position. When the expansion assembly is disposed within a tubular member and in the second position, the primary cone segments expand the tubular member into a tri-lobe cross-sectional shape.

Another embodiment of the disclosure provides a method for expanding a tubular by assembling an expansion system that includes a mandrel that is slidably coupled to plurality of primary cone segments that are interleaved with a plurality of secondary cone segments. The expansion system is assembled in a first position and disposed into a tubular member having an unexpanded inner diameter. The expansion system is transitioned to a second position where the primary cone segments radially expand the tubular member into a tri-lobe cross-sectional shape. The expansion system is then transitioned to a third position where the primary and secondary cone segments radially expand the tubular member into a circular cross-sectional shape and axially translated through the tubular member.

Another embodiment of the disclosure provides a method for expanding a tubular by disposing a plurality of primary cone segments interleaved with a plurality of secondary cone segments into a tubular member. The primary cone segments are slid along a mandrel in a first direction so as to move the primary cone segments outward and expand the tubular member into a tri-lobe cross-sectional shape. The secondary cone segments are then also slid along the mandrel in a first direction so as to move the secondary cone segments outward and expand the tubular member into a circular cross-sectional shape. The primary and secondary cone segments are then translated through a portion of the tubular member.

BRIEF DESCRIPTION OF THE DRAWINGS

For a more detailed description of the embodiments of the present disclosure, reference will now be made to the accompanying drawings.

DETAILED DESCRIPTION

Figure 1:
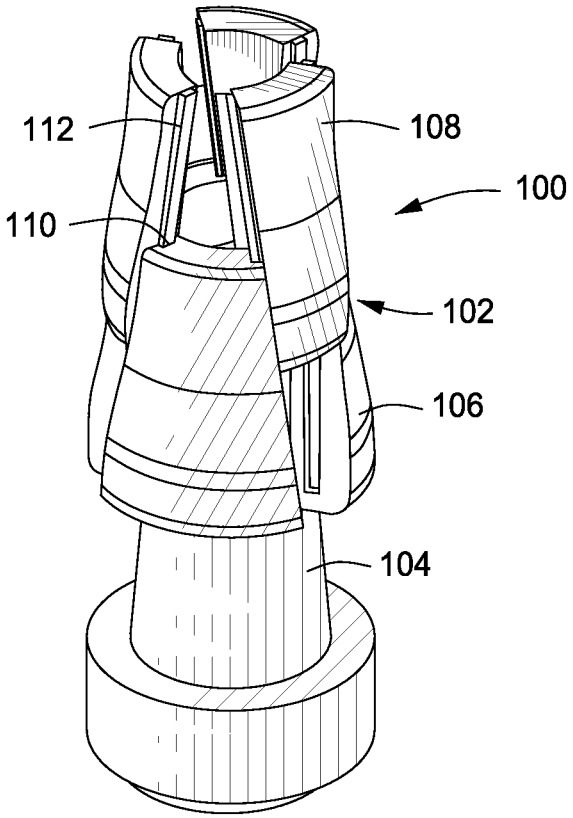
FIG. 1 illustrates an expandable cone assembly in a retracted position.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Additionally, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 2:
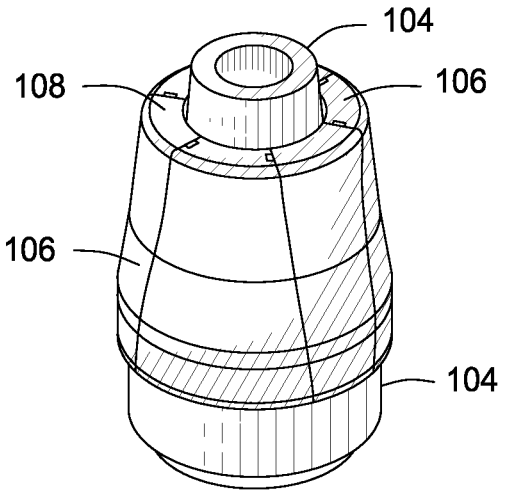
FIG. 2 illustrates the expandable cone assembly of FIG. 1 in an expanded position.

Referring initially to FIGS. 1 and 2, an expandable cone assembly 100 includes a plurality of cone segments 102 slidably coupled to a mandrel 104 having a sloped outer surface. The cone segments 102 include three primary cone segments 106 that are interleaved with three secondary cone segments 108. Slots 110 on the primary cone segments 106 slidably engage with tabs 112 on the secondary cone segments 108 to maintain a proper alignment between adjacent segments 102. The expandable cone assembly 100 has a retracted position that is shown in FIG. 1 in which the secondary cone segments 108 are axially offset from the primary cone segments 106. In the retracted position, the outer most edge of the primary cone segments 106 may be in contact with the inner diameter of a tubular member (not shown).

The expandable cone assembly 100 can be shifted from the retracted position shown in FIG. 1, to an expanded position, as is shown in FIG. 2, by translating the cone segments 102 along the sloped outer surface of mandrel 104. It is understood that the movement of the cone segments 102 relative to the mandrel 104 could be achieved by moving either or both of the segments and the mandrel. For purposes of this description, the transition from the retracted to the expanded position is achieved by holding the cone segments 102 in a substantially stationary axial position relative to the mandrel 104 as the mandrel is moved axially relative to the cone segments 102. As the mandrel 104 moves, the diameter of the mandrel that contacts a particular cone segment 102 increases and the segment is moved radially outward. Once expandable cone assembly 100 has fully transitioned to an expanded position, the cone segments 102 form an expansion cone that can be translated through and radially expand a tubular member (not shown).

Figure 3:
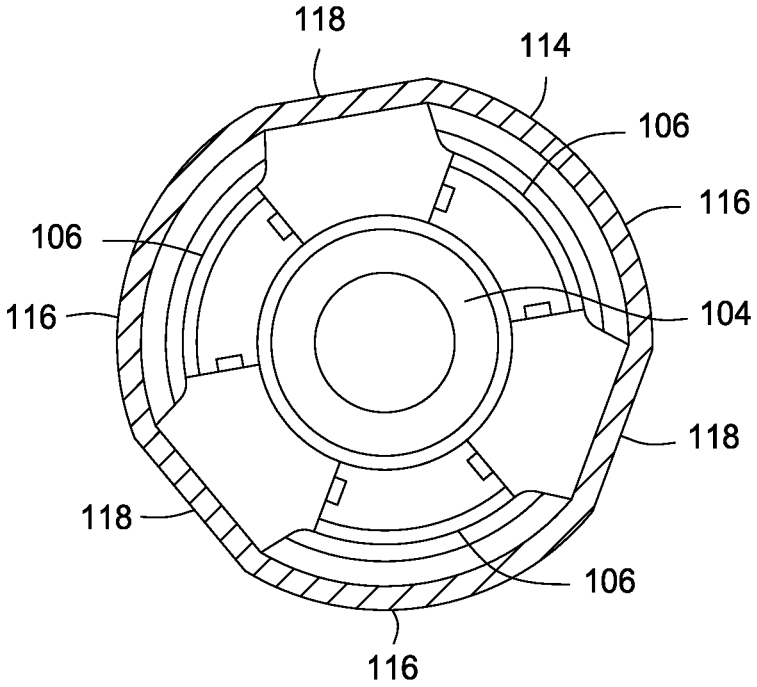
FIG. 3 is a partial sectional end view of the expandable cone assembly of FIG. 1 in a first phase of transition between the retracted and expanded positions.
Figure 4:
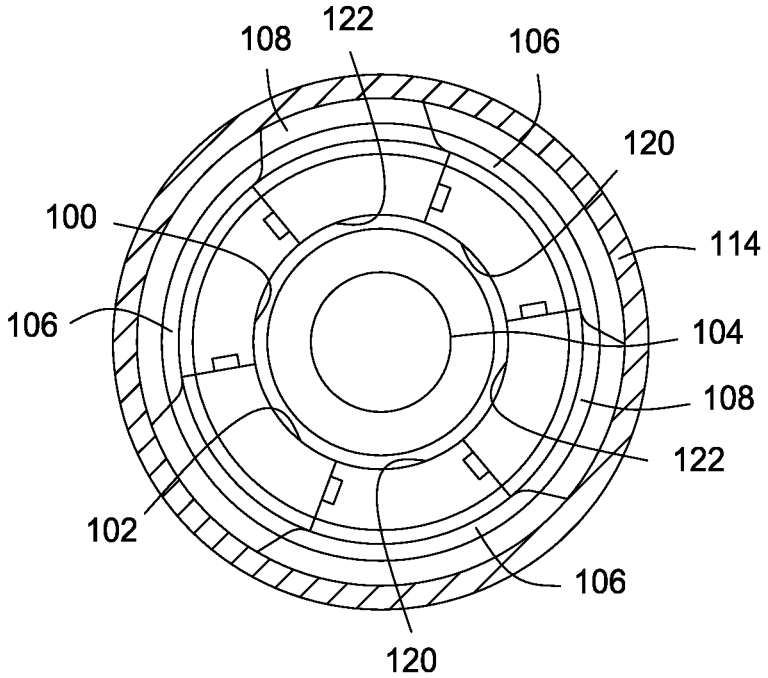
FIG. 4 is a partial sectional end view of the expandable cone assembly of FIG. 1 in the expanded position.

Referring now to FIGS. 3 and 4, transitioning the expandable cone assembly 100 from the retracted position to the expanded position occurs in two phases. In a first phase, the primary cone segments 106 are moved outward into a position that causes radially expansion of the tubular member 114 while the secondary cone segments 108 remain retracted in a position that does not cause radial expansion of the tubular member 114. As the primary cone segments 106 expand the tubular member 114, the secondary cone segments 108 may remain in a fully retracted position or may begin to move outward toward the tubular member 114.

As the primary cone segments 106 are moved outward by the interaction with mandrel 104, they expand the tubular member 114 into a tri-lobe cross-sectional shape, as is shown in FIG. 3. When expanded into the tri-lobe cross-sectional shape, the tubular member 114 has portions 116 that are in contact with and have been radially expanded by the primary cone segments 106 and substantially linear portions 118 that span the gaps between the primary cone segments 106 and have not been directly radially expanded.

Once the primary cone segments 106 have expanded the tubular 114 into the tri-lobe cross-sectional shape of FIG. 3, continued movement of the mandrel 104 moves the primary cone segments 106 upward and outward relative to the primary cone segments 106 so that the secondary cone segments 108 slide into position between the primary cone segments 106 and expand the tubular 114 into a full circular cross-sectional shape, as shown in FIG. 4. Because each phase of the cone transition process only expands a portion of the tubular 114, the force needed to transition the assembly 100 from the retracted position to the expanded position is reduced as compared to conventional adjustable cones that simultaneously expand a greater portion of the tubular member as the cone is assembled.

During and after the transition of the assembly 100 from the retracted position to the expanded position, each of the cone segments 102 is fully supported on the mandrel. Each primary segment 106 has an inner surface 120 that is in contact with the mandrel 104 and adjacent secondary segments 108. Each secondary segment 108 has an inner surface 122 that is also in contact with the mandrel 104. These contact surfaces allow the cone segments 102 to be fully supported by the mandrel 104, which helps distribute the stresses created during the transition process and during expansion of the tubular 114. Because the cone segments 102 are fully supported by the mandrel 104 slots 110 and tabs 112 serve only to maintain alignment and limit axial offset of the segments and do not bear significant radial loading. In certain embodiments, slots 110 and tabs 112 may be rectangular slots and tabs (as shown in FIGS. 1-4) or may be dovetail slots and tabs (as shown in FIGS. 5-8). Other shapes and styles of engagement between the cone segments 102 and the mandrel 104 are suitable for use in maintaining alignment and limiting axial offset of the segments.

Referring now to FIGS. 5-8, an expandable cone assembly 200 includes a plurality of cone segments 202 slidably coupled to a mandrel 204. The cone segments 202 include three primary cone segments 206 that are interleaved with three secondary cone segments 208. Slots 210 on the primary cone segments 206 engage with tabs 212 on the secondary cone segments 208 to maintain alignment and limit axial offset between the segments 202. Mandrel 204 also includes guide rails 213 that engage and align the primary cone segments 206 with the mandrel. The secondary cone segments 208 include retention tabs 215 that engage with a housing (not shown) that limits the axial travel of the secondary cone segments 208.

Figure 5:
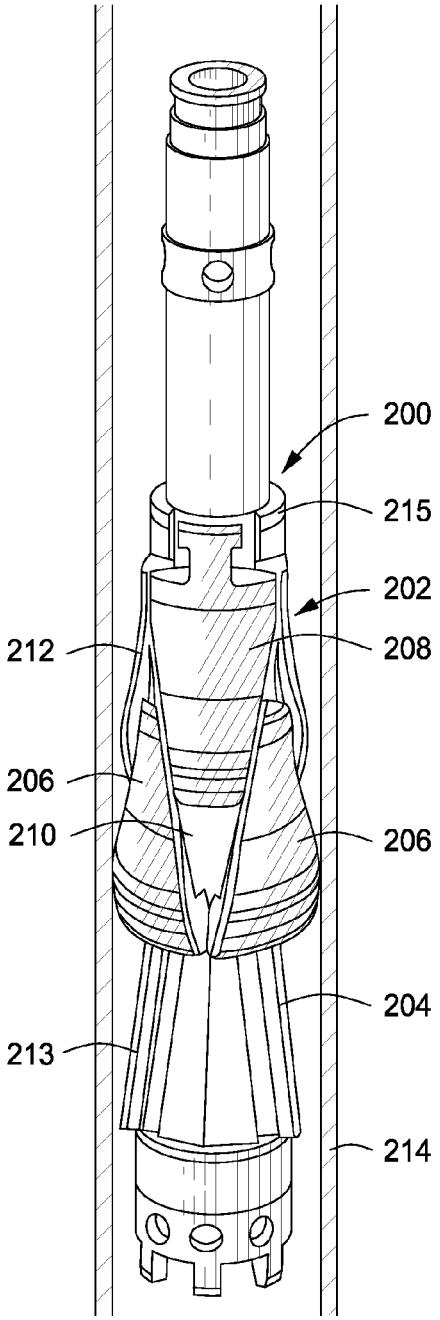
FIG. 5 is a partial sectional elevation view of an expandable cone assembly in a retracted position disposed within a tubular member.
Figure 6:
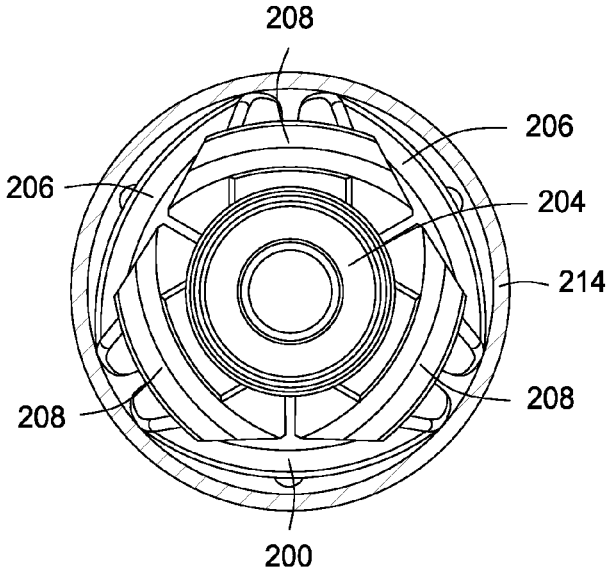
FIG. 6 is a partial sectional end view of the expandable cone assembly of FIG. 5.
Figure 7:
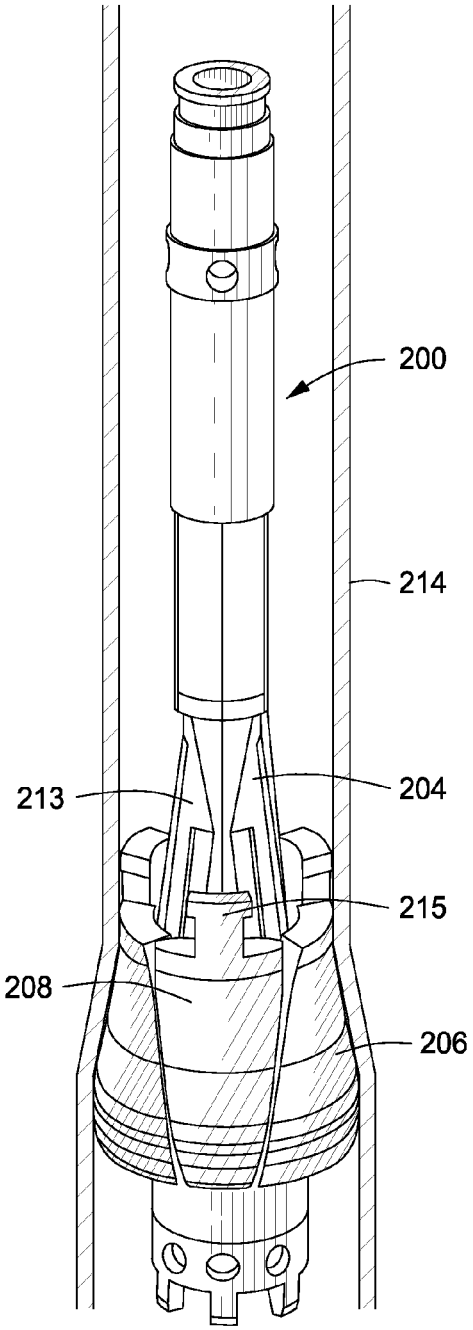
FIG. 7 is a partial sectional elevation view of an expandable cone assembly in an expanded position disposed within a tubular member.

The expandable cone assembly 200 has a retracted position that is shown in FIGS. 5 and 6 in which the secondary cone segments 208 are axially offset from the primary cone segments 206. The expandable cone assembly 200 can be disposed within an expandable tubular 214 and run into a wellbore in the retracted position. The expandable cone assembly 200 is transitioned to an expanded position of FIGS. 7 and 8 by axially translating the mandrel 204 relative to the cone segments 202.

Figure 8:
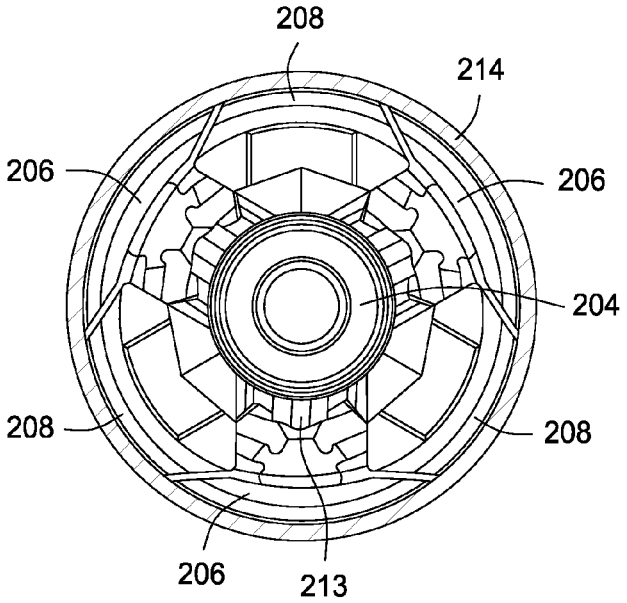
FIG. 8 is a partial sectional end view of the expandable cone assembly of FIG. 7.

As transition of the expandable cone assembly 200 is initiated, the cone segments 202 are held in a substantially stationary axial position by engagement of the secondary cone segments 208 with the housing (not shown) and the contact between the primary cone segments 206 and the inner diameter of the tubular member 214. The relative axial translation of the mandrel 204 causes the primary cone segments 206 to move radially outward and expand the tubular member 214. The tubular member 214 is initially expanded into a tri-lobe cross-sectional shape, as is shown in FIG. 3. Continued movement of the mandrel 204 causes the secondary cone segments 208 to move radially outward and expand the tubular member 214 into a circular cross-sectional shape, as is shown in FIG. 8. Once expandable cone assembly 200 has fully transitioned to an expanded position, the cone segments 202 form an expansion cone that can be translated through and radially expand an extended length of the tubular member 214. In certain embodiments, guide rails 213 and the primary cone segments 206 are configured so that the movement of the mandrel 204 in the opposite direction can also transition the assembly 100 from the expanded position back to the retracted position.

As discussed above, the force needed to transition the assembly 200 from the retracted position to the expanded position is reduced as compared to conventional adjustable cone systems. Therefore, systems utilizing the expandable cone assembly 200 do not need specialized actuators or specialized tubular sections for the transition of the assembly from the retracted to the expanded position.

Figure 9:
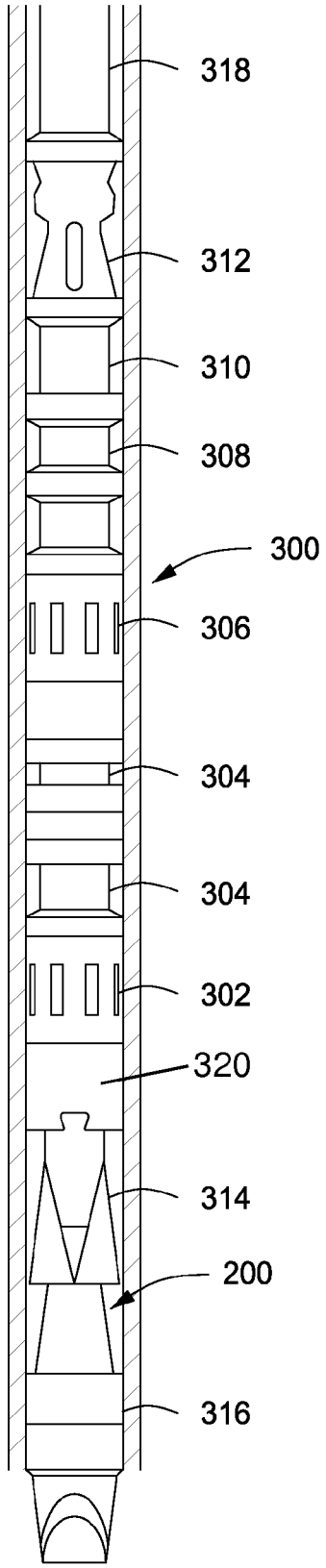
FIG. 9 is a partial schematic view of an expansion assembly.

Referring now to FIG. 9, an expansion assembly 300 is shown including an expandable cone assembly 200, a cone lock 302, cup seals 304, casing lock 306, release sub 308, debris catcher 310, and a casing cutter 312. The expansion assembly 300 is disposed within an expandable tubular 314 having a float shoe 316. Casing lock 306 and cone lock 302 releasably couple the expansion assembly 300 to the expandable tubular 314. The expansion assembly 300 is supported by drill pipe 318 that is coupled to a source of pressurized fluid, such as surface mud pumps.

The expansion assembly 300 and expandable tubular 310 are disposed in a wellbore (not shown). The expansion assembly 300 may be configured to allow fluid circulation from the drill pipe 318 and through the float shoe 316 into the wellbore to support circulation during running and cementing operations. To begin the expansion process, a valve located in the float shoe 316 is closed, such as by dropping a ball or dart, isolating the interior of the expandable tubular 314 from the wellbore.

Pressurized fluid is pumped through the drill pipe 318 and into the expandable tubular 314 at a location between the cup seals 304 and the float shoe 316. The cup seals 304 sealingly engage the expandable tubular 314 so that pressurized fluid is contained within the expandable tubular between the cup seals 304 and the float shoe 316. As the pressure in the expandable tubular 314 increases, the casing lock 306 releases and the expansion assembly 300 can move relative to the expandable tubular 314. The cone lock 302 remains engaged with the expandable tubular 314 and acts to hold then housing 320 and the cone segments 202 in place as mandrel 204 is moved upward by the pressure acting on the cup seals 304.

As previously described, movement of the mandrel 204 upward relative to the cone segments 202 transitions the cone segments from a retracted position to an expanded position. Once the expandable cone assembly 200 is fully expanded, the cone lock 302 disengages from the tubular 314 and pressurized fluid within the tubular will move the expansion assembly 300 through the tubular. The expandable cone assembly 200 radially expands the tubular 314 as the expansion assembly 300 moves through the tubular.

Once expansion of the expandable tubular 314 is complete, the expandable cone assembly 200 can be transitioned back to a retracted position. The expandable cone assembly 200 is retracted by reengaging the tubular 314 with the cone lock 302 and then moving the mandrel 204 downward so that the cone segments 202 can retract. The casing cutter 312 can be used to detach any unexpanded portions of the tubular 314 from the expanded portions and the expansion assembly 300 can be retrieved from the wellbore.

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. An expansion system comprising:

a mandrel having a sloped outer surface that extends between a first end and a second end, wherein the second end is radially larger than the first end;

a plurality of primary cone segments, wherein each of the plurality of primary cone segments has an inner surface in contact with the sloped outer surface; and a plurality of secondary cone segments interleaved with the plurality of primary cone segments, wherein each of the plurality of secondary cone segments has an inner surface in contact with the sloped outer surface;

wherein the expansion system has a first position wherein the plurality of primary cone segments and the plurality of secondary cone segments are in a retracted position;

wherein the expansion system has a second position wherein the plurality of secondary cone segments are in a retracted position and the plurality of primary cone segments are in an expanded position;

wherein the expansion system has a third position wherein the plurality of primary cone segments and the plurality of secondary cone segments are in an expanded position;

wherein as the expansion system is moved from the first position to the second position and from the second position to the third position, both the plurality of primary cone segments and the plurality of secondary cone segments move axially along the mandrel toward the second end; and wherein the inner surface of each of the plurality of primary cone segments and the inner surface of each of the plurality of secondary cone segments maintains contact with the sloped outer surface of the mandrel as the expansion system is moved from the first position to the second position and from the second position to the third position.

2. The expansion system of claim 1, wherein the plurality of primary cone segments consists of three primary cone segments and the plurality of secondary cone segments consists of three secondary cone segments.

3. The expansion system of claim 1, wherein the each of the plurality primary cone segments is slidably coupled to adjacent secondary cone segments by a tab engaged with a corresponding slot.

4. The expansion system of claim 3, wherein the tab is a dovetail tab and the slot is a dovetail slot.

5. The expansion system of claim 1, further comprising a plurality of guide rails disposed on the mandrel, wherein the plurality of guide rails engage and align the plurality of primary cone segments and the plurality of secondary cone segments with the mandrel.

6. The expansion system of claim 1, wherein the expansion system is moved from the first position to the second position and from the second position to the third position by axially translating the mandrel relative to the plurality of primary cone segments and the plurality of secondary cone segments.

7. The expansion system of claim 1, further comprising a tubular member disposed about the plurality of primary cone segments and the plurality of secondary cone segments, wherein in the second position the plurality of primary cone segments expand the tubular member into a tri-lobe cross-sectional shape.

8. The expansion system of claim 7, wherein in the third position the plurality of secondary cone segments expands the tubular member into a circular cross-sectional shape.

9. An expandable cone assembly comprising:

a mandrel having a sloped outer surface; and a plurality of cone segments slidably coupled to the mandrel, wherein the plurality of cone segments includes at least three primary cone segments interleaved with an equal number of secondary cone segments, and wherein each of the plurality of cone segments has an inner surface;

wherein the plurality of cone segments has a retracted position wherein the primary cone segments are axially offset from the secondary cone segments and an expanded position wherein the primary cone segments and the secondary cone segments are aligned to form an expansion cone;

wherein the expandable cone assembly is moved from the retracted position to the expanded position by translating all of the plurality of cone segments along the mandrel in the same axial direction; and wherein the inner surfaces of each of the plurality cone segments remain in contact with the mandrel in the retracted position, the expanded position, and as the plurality of cone segments are moved from the retracted position to the expanded position.

10. The expandable cone assembly of claim 9, wherein the each of the primary cone segments is slidably coupled to adjacent secondary cone segments by a tab engaged with a corresponding slot.

11. The expandable cone assembly of claim 9, further comprising a plurality of guide rails disposed on the mandrel, wherein the plurality of guide rails engage and align the plurality of cone segments with the mandrel.

12. The expandable cone assembly of claim 9, further comprising a tubular member disposed about the plurality of cone segments; wherein as the expandable cone assembly transitions from the retracted position to the expanded position, the primary cone segments expand the tubular member into a tri-lobe cross-sectional shape.

13. The expandable cone assembly of claim 12, wherein in the expanded position the secondary cone segments expand the tubular member into a circular cross-sectional shape.

14. A method comprising:

assembling an expandable cone assembly by slidably coupling a plurality of cone segments to a mandrel having a sloped outer surface; wherein the plurality of cone segments consists of three primary cone segments interleaved with an equal number of secondary cone segments, and wherein each of the plurality of cone segments has an inner surface disposing the expandable cone assembly in a retracted position wherein the primary cone segments are axially offset from the secondary cone segments and the inner surface of each of the plurality of cone segments is in contact with the mandrel;

disposing the expandable cone assembly in the retracted position within a tubular member so that each of the plurality of cone segments are disposed within an unexpanded inner diameter of the tubular member;

translating the mandrel relative to the plurality of cone segments so as to move the inner surfaces of the plurality of cone segments along the sloped outer surface so that the primary cone segments move radially outward and expand the tubular member into a tri-lobe cross-sectional shape;

translating the mandrel relative to the plurality of cone segments so as to move the inner surfaces of the secondary cone segments along the sloped outer surface so that the secondary cone segments move radially outward and expand the tubular member into a circular cross-sectional shape; and translating the expandable cone assembly through the tubular member.

15. The method of claim 14, wherein the each of the primary cone segments is slidably coupled to adjacent secondary cone segments by a tab engaged with a corresponding slot.

16. The method of claim 14, further comprising a plurality of guide rails disposed on the mandrel, wherein the plurality of guide rails engage and align the plurality of cone segments with the mandrel.

17. The method of claim 16, further comprising:

translating the mandrel relative to the plurality of cone segments so as to move the plurality of cone segments radially inward to the retracted position; and removing the expandable cone assembly from the tubular member.

* * * * *